US008915506B2

(12) United States Patent
Piaceski et al.

(10) Patent No.: US 8,915,506 B2
(45) Date of Patent: Dec. 23, 2014

(54) INLINE SKATEBOARD WITH DIFFERENTIATED WHEELS

(75) Inventors: Bernardo Dakiw Piaceski, Curitiba (BR); George Luiz Antunes, Curitiba (BR)

(73) Assignee: Rollerboard Comercio de Artigos Esportivos LTDA-EPP, Parana (BR)

( * ) Notice: Subject to any disclaimer, the term of this patent is extended or adjusted under 35 U.S.C. 154(b) by 1507 days.

(21) Appl. No.: 12/067,749

(22) PCT Filed: Sep. 22, 2006

(86) PCT No.: PCT/IB2006/053427

§ 371 (c)(1), (2), (4) Date: Mar. 21, 2008

(87) PCT Pub. No.: WO2007/034436

PCT Pub. Date: Mar. 29, 2007

(65) Prior Publication Data

US 2008/0191438 A1 Aug. 14, 2008

(30) Foreign Application Priority Data

Sep. 22, 2005 (BR) ..... 0504027

(51) Int. Cl.

*A63C 17/06* (2006.01)
*A63C 17/01* (2006.01)
*A63C 17/00* (2006.01)

(52) U.S. Cl.

CPC ..... *A63C 17/01* (2013.01); *A63C 17/016* (2013.01); *A63C 17/006* (2013.01); *A63C 17/0033* (2013.01)

USPC ..... 280/87.042; 280/11.27

(58) Field of Classification Search

USPC ..... 280/87.042, 87.03, 11.27, 11.28

See application file for complete search history.

(56) References Cited

U.S. PATENT DOCUMENTS

| | | | | | |
|---|---|---|---|---|---|
| 2,570,349 | A | * | 10/1951 | Kardhordo | 280/11.222 |
| 4,382,605 | A | * | 5/1983 | Hegna | 280/11.225 |
| 5,803,473 | A | * | 9/1998 | Bouden | 280/87.042 |
| 5,984,328 | A | * | 11/1999 | Tipton | 280/87.042 |
| 6,098,997 | A | * | 8/2000 | Cheng | 280/11.28 |
| 6,161,846 | A | * | 12/2000 | Soderberg | 280/11.225 |
| 6,193,249 | B1 | * | 2/2001 | Buscaglia | 280/87.042 |
| 6,267,394 | B1 | * | 7/2001 | Bouden | 280/87.042 |
| 6,270,096 | B1 | * | 8/2001 | Cook | 280/87.042 |
| 6,315,304 | B1 | * | 11/2001 | Kirkland et al. | 280/11.28 |

(Continued)

FOREIGN PATENT DOCUMENTS

| | | |
|---|---|---|
| BR | 0004277 | 5/2002 |
| CN | 2516199 Y | 10/2002 |

(Continued)

*Primary Examiner* — Jeffrey J Restifo

(74) *Attorney, Agent, or Firm* — Sughrue Mion, PLLC

(57) ABSTRACT

"INLINE SKATEBOARD WITH DIFFERENTIATED WHEELS' that has wheels with different predetermined sizes being affixed by means of two trucks to the shape. Besides the wheels, the two trucks have a shock absorber device, a metallic base structure and a torsion system for the execution of curves with the automatic alignment of the wheel sets with the shape after turning movement completion. Thus, the movement is limited by three features combined: the size of the internal wheels, the sliding of the internal screw through the aperture of the wheels axles' fixation support and the sliding of the intermediary parts of the recesses of the torsion device mortise aperture with the wheels axles' fixation support relative to the sleeve apertures.

18 Claims, 14 Drawing Sheets

(56) References Cited

U.S. PATENT DOCUMENTS

| | | | | |
|---|---|---|---|---|
| 6,315,312 | B1 * | 11/2001 | Reyes et al. | 280/87.042 |
| 6,428,022 | B1 * | 8/2002 | Namiki | 280/87.042 |
| 6,431,568 | B1 * | 8/2002 | McCleese | 280/87.042 |
| 6,523,837 | B2 * | 2/2003 | Kirkland | 280/11.28 |
| D505,468 | S * | 5/2005 | Mejia | D21/765 |
| 7,083,178 | B2 * | 8/2006 | Potter | 280/87.042 |
| 7,195,259 | B2 * | 3/2007 | Gang | 280/87.042 |
| 7,243,930 | B1 * | 7/2007 | Wakley | 280/87.042 |
| 7,338,056 | B2 * | 3/2008 | Chen et al. | 280/87.042 |
| 7,445,069 | B2 * | 11/2008 | Negoro et al. | 180/181 |
| 7,458,435 | B2 * | 12/2008 | Negoro et al. | 180/180 |
| D593,174 | S * | 5/2009 | Giannatos | D21/765 |
| 7,621,541 | B2 * | 11/2009 | Perkovich | 280/11.231 |
| 2002/0195788 | A1 * | 12/2002 | Tierney et al. | 280/87.042 |
| 2003/0141688 | A1 * | 7/2003 | Lynn | 280/87.042 |
| 2006/0213711 | A1 * | 9/2006 | Hara | 180/181 |
| 2007/0273118 | A1 * | 11/2007 | Conrad | 280/87.042 |
| 2008/0191438 | A1 * | 8/2008 | Piaceski et al. | 280/87.042 |

FOREIGN PATENT DOCUMENTS

| | | |
|---|---|---|
| DE | 1077586 | 3/1960 |
| JP | 2005-118443 | 5/2005 |
| WO | 2005/039710 A1 | 5/2005 |

* cited by examiner

INLINE SKATEBOARD WITH DIFFERENTIATED WHEELS

BACKGROUND

1 Technical Field

The present invention relates to the technical field of propulsion of wheeled vehicles by the users, more particularly to boards on wheels with the wheels placed in pairs.

2 Background Art

Boards on wheels used for radical sports, also known as 'skates', usually include a board with ends slightly bent upward, known as 'shape', two support structures for wheels, commonly called trucks, with a total of four wheels attached thereto by means of affixing said wheels axles onto said trucks. The truck is commonly attached directly to the shape by a central screw, an additional device to help fasten said screw to the shape, commonly known as sleeve, can also be employed.

Conventional skates usually comprise four identical wheels, placed in pairs side by side, two trucks affixed to the shape with each pair of wheels being mounted onto each truck. The wheels are symmetrically distributed in relation to the longitudinal axis of the shape.

Such configuration of conventional skates generally generates friction during maneuvers, making it more difficult to execute the movements necessary for maneuvering.

Skates with diverse constructive assemblies that aim to obtain a more efficient maneuverability without compromising stability are already known in the art.

As an example, the WO 02/062431 A1 discloses a skate comprising an elongated shape, a pair of trucks and a pair of wheels, all placed inline in relation to the shape. Each truck includes one wheel support that can rotate in relation to the shape, a spring for movement detention connected to the wheel support in order to stop the support pivoting relative to the shape, besides several other parts for fixation and sliding of the set.

Another example is US 2003/0141688 A1, which discloses a skate including base structure attached underneath the shape and wheel trucks that can rotate, relative to the base structure, around the fixation element on the base structure. Each wheel truck comprises two parallel sets; each set composed of two inline wheels, preferably aligned with the two sets of the other truck. Furthermore, an elastomer device, which besides permitting the truck pivoting, also promotes shock absorption.

The BR 0004277-3 discloses a skate comprising aligned wheels centralized inline along the shape. Thus the skate is comprised of four wheels mounted two by two onto two trucks fixed to the shape central axis near the board ends.

Technical-Problem

The solutions described above and others existing in the prior art do not efficiently and conveniently solve some of the current problems in the technical field of board on wheels with propulsion by user.

The document WO 02/062431 A1 describes a skate that, despite having inline wheels and additional devices such as the movement restraining spring, it has a quite complex truck set, which makes manufacturing, maintaining and repairing more difficult. Moreover, it has only two wheels; such configuration impairs the skate stability.

The document US 2003/0141688 A1 discloses a skate that, despite having inline wheels, it has eight wheels aligned four by four mounted in two trucks, a configuration that increases the friction between the ground and wheels, which makes maneuverability and apparatus control more difficult. Furthermore, said trucks only allow small range movements relative to the board, decreasing skate drivability.

The document BR 0004277-3 describes a skate with four aligned wheels that, despite promoting more stability and drivability, do not stay in permanent contact with the ground due to said wheels being identical. The said document, as well as the others, also does not have an adequate rigid base structure between the truck and the shape, thus considerably decreasing the skate stability and shape durability, therefore, the contact area between the shape and the trucks is subjected to a bigger strain and, considering the difference between the shape and trucks materials, the shape is subjected to corrosion.

Another problem not solved in the documents previously mentioned relates to the fact that in the disclosed skates the trucks are affixed to the shape by means of a central screw located in the rotation axis; such configuration decreases the apparatus durability due to the vibration caused by the skate movement which causes the loosening of the screw.

Moreover, trucks with solid frameworks, as in the documents US 2003/0141688 A1 and WO 02/062431 A1, unnecessarily increase the skate weight, on the other hand, the truck disclosed in the document BR 0004277-3 is also deficient relative to impact resistance, due to the fragility of the areas subjected to bigger effort forces, such as those near the wheels axles.

Therefore, the solutions shown in the previous art do not conveniently solve the existing problems in the art, especially concerning the obtaining of a skate which offers adequate stability to maneuverability and allows the user to reach high speeds without a structure that has added weight due to complex devices aiming stability and speed characteristics.

SUMMARY

The object of the present invention is to provide a skate with high stability and drivability, without compromising its weight and durability. Another object of the present invention is to provide a skate with fast mounting and dismounting, facilitating the equipment manufacture and maintenance operations, without compromising its stability, drivability and durability, or increase its weight.

In order to reach the objectives above mentioned and other purposes, the present application discloses a skate with four aligned wheels, being such wheels of different pre-determined sizes mounted in pairs onto two trucks that are affixed to a shape that can be of similar format to the conventional ones, preferably longer though. The proportion of the dimensions of one wheel in relation to the other is calculated aiming to guarantee that all four wheels stay in constant contact with the ground during maneuvering, this is achieved through utilization of the compensation between the axles and the rotation angle, being the internal wheels wider with a profile composed of only one radius, and the external ones being narrower with a profile defined by a concordance of arches of the projection of the internal wheel profile points.

Besides the two wheels, the two trucks also have a shock absorber device, a metallic base structure and a torsion system for the execution of curves with the automatic alignment of the trucks with the shape after turning movement completion.

Each truck is affixed to the shape by three screws, being two of them placed around the truck pivot axis relative to the shape, preferably diametrally opposed; elastomer elements, such as polyurethane, are also employed around the screws to achieve better fixation.

The metallic fixation base and the wheels axels fixation support have openings on areas that are susceptible to less strain in order to decrease the amount of material being used and consequently decrease trucks weight without diminishing the skate resistance and durability.

The truck is of easy and quick assembling and of light weight, otherwise, the lack of such characteristics would interfere with the skate's weight.

Furthermore, the truck rotation angle is limited by three combined characteristics:

the size of the internal wheels, the sliding of a screw through the aperture in the wheels axles fixation support and the sliding of the intermediary parts of the recesses of the torsion device mortise aperture with the wheels axles fixation support relative to the sleeve apertures. Thus this movement is possible only due to the difference of width and profile between the internal and external wheels.

By displaying all wheels aligned, the skate is able to attain higher speeds due to the little friction between the wheels and the surface on which the skate is used.

By comprising a longer board, the skate provides up to 80% more stability by decreasing its vibration frequency during maneuvering.

The board incline angle and the torsion system provide adequate mobility and movement diversity. Moreover, the torsion system guarantees the automatic alignment of the trucks with the board immediately after turning movement completion.

The proportion of the dimensions of one wheel relative to the other, as well as the axles and the rotation angle characteristics, guarantees that all four wheels stay in permanent contact with the ground during maneuvering providing more stability and adherence to the surface including during curves, and allowing a bigger variation of maneuvers.

The disclosed shock absorber system is simple and of easy assembly.

The metallic fixation base protects the board, which is usually made of wood, avoiding damage such as wood corrosion due to the trucks attachment therein.

The attachment of the trucks to the board by two screws adjacent to the rotation axis, instead of only one screw directly into the rotation axis, plus the use of elastomer material devices, such as polyurethane, guarantee a better fixation of the screws and avoid the loosening thereof due to vibration during maneuvering.

The metallic base structure and the wheels axles' fixation support include openings on areas susceptible to lower effort forces in order to decrease the amount of material being used, and consequently diminish the weight of the wheels sets. The disposition of said openings on areas susceptible to lower efforts guarantees the set resistance, avoiding damage thereof during maneuvering.

Besides being light, the truck is also of easy and quick assembly, not interfering significantly on the skate weight, or else it would unable convenient use. Therefore, repair and maintenance operations are facilitated.

In order to limit the wheels set rotation movement, three limiting features operate together: the size of the internal wheels, the sliding of the internal screw through the aperture of the wheels axles fixation support and the sliding of the intermediary parts of the recesses of the torsion device mortise aperture with the wheels axles fixation support relative to the sleeve apertures. This way, being safety a critical factor in radical sports, it is more efficiently provided during movements.

BRIEF DESCRIPTION OF THE DRAWINGS

For a better understanding and execution of the invention, the following drawings are showed in an illustrative way, not representing a limiting embodiment of the invention.

FIG. 11 is a bottom view of a skate according to the present invention in a turning movement to the right.

DETAILED DESCRIPTION OF THE EXEMPLARY EMBODIMENTS

Figure 1:
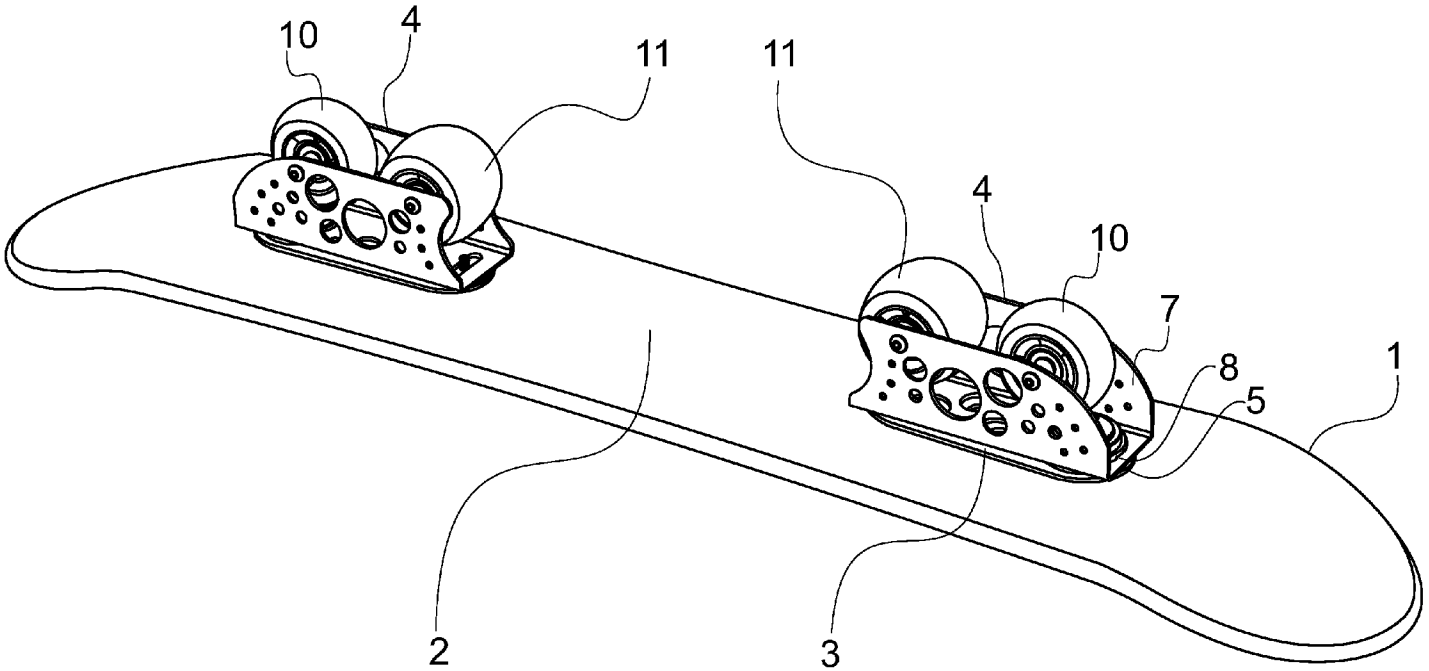
FIG. 1 is a perspective bottom view of a skate according to the present invention.
Figure 2:
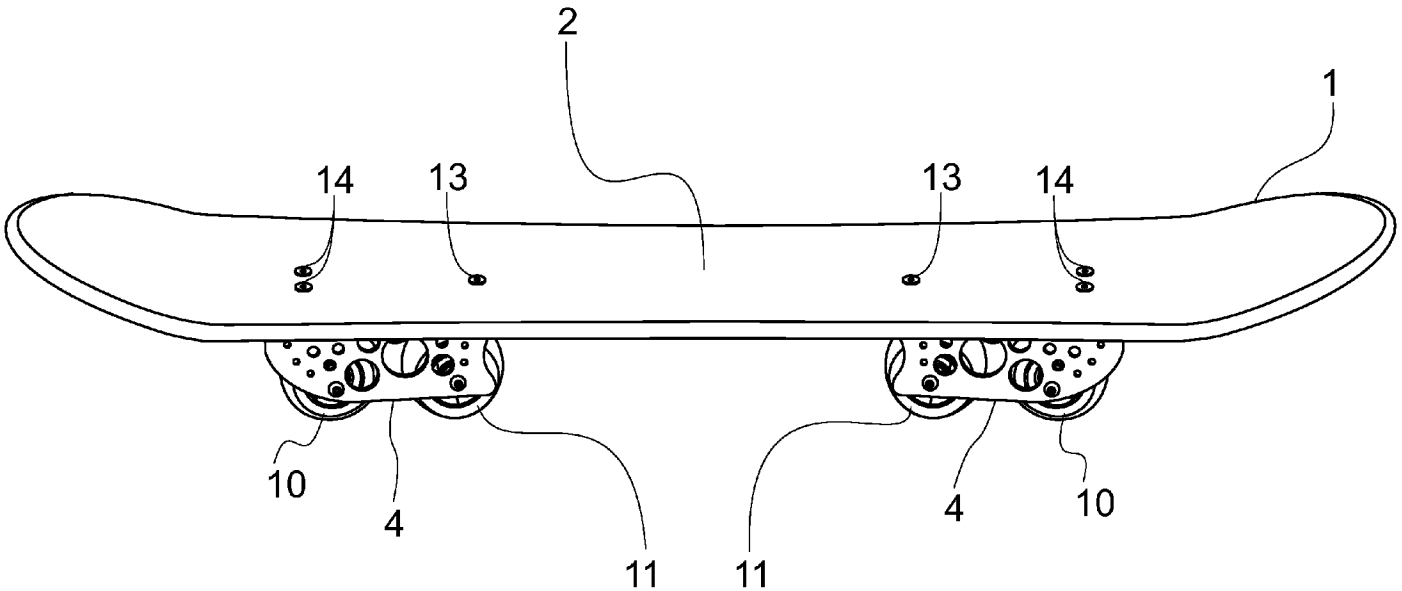
FIG. 2 is a perspective upper view of a skate according to the present invention.
Figure 3:
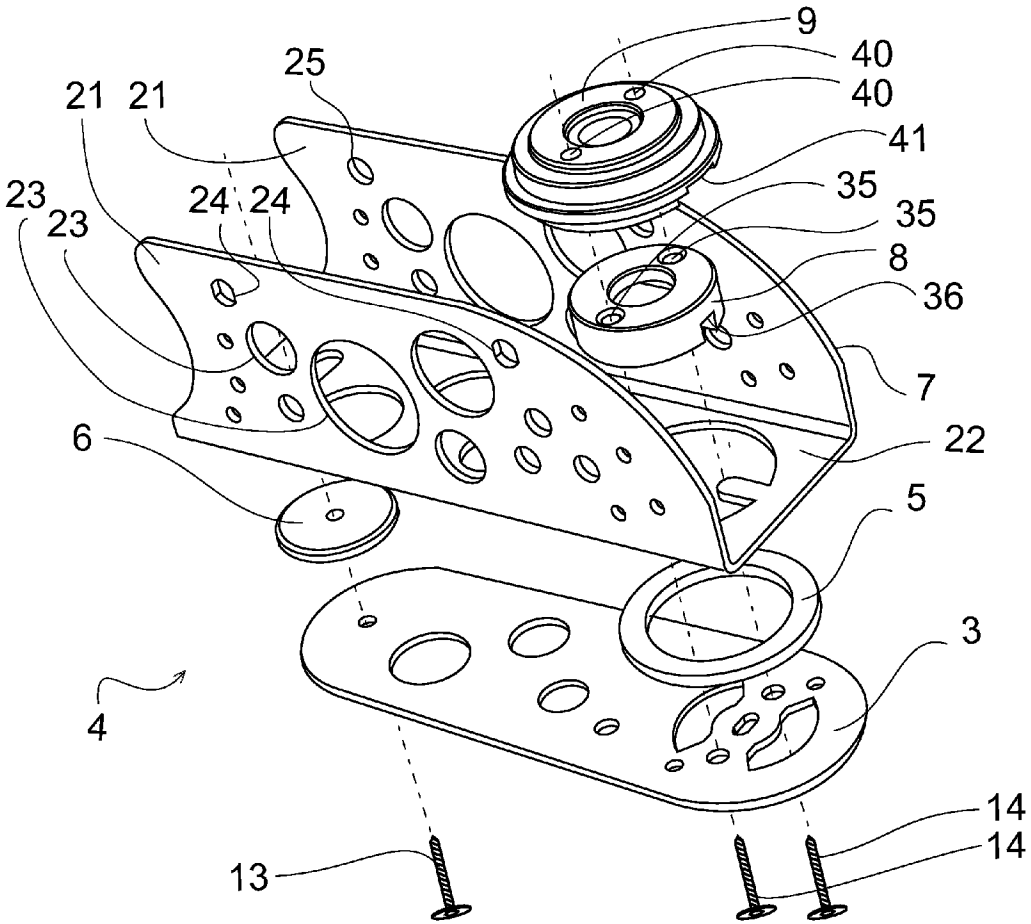
FIG. 3 is an exploded perspective view of the truck.

According to the illustrations above referred, the present invention relates to a skate (1) comprising an elongated shape (2) and two aligned trucks (4) affixed underneath the shape by means of a metallic fixation base (3). Each truck (4) is composed of two shock absorber devices (5) and (6), and one wheels axles fixation support (7), and one torsion device (8); one sleeve (9); and two aligned wheels, one external (10) and one internal (11) with different and pre-determined sizes.

The shape (2) has a more elongated length, providing more stability to the developed skate (1).

Figure 4:
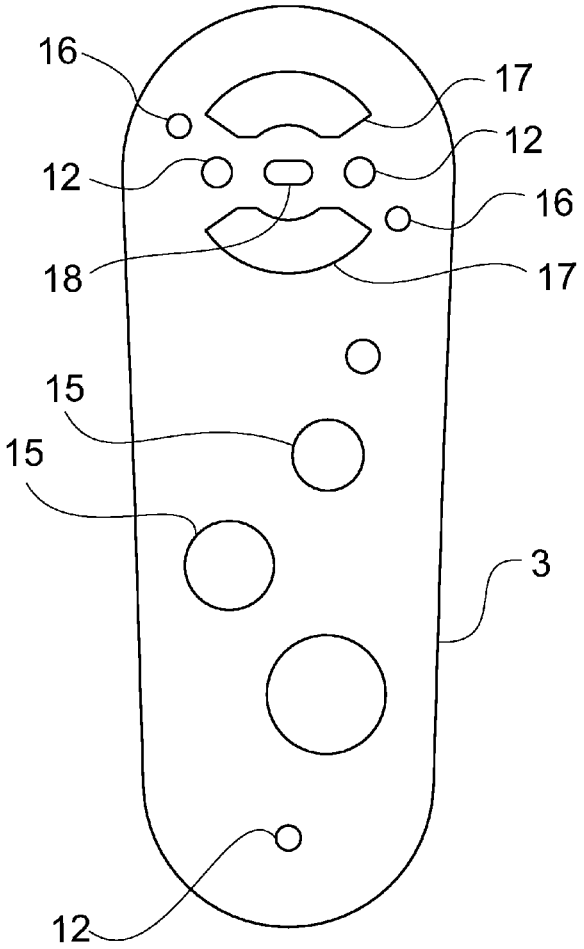
FIG. 4 is a lower surface view of a metallic fixation base.
Figure 5:
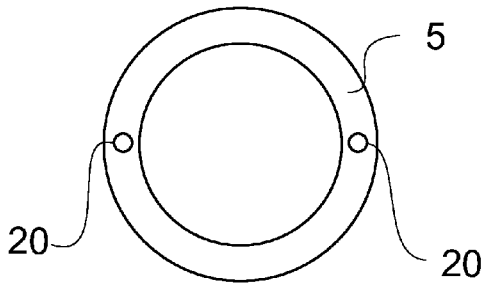
FIG. 5 is a top view of the shock absorber device with the biggest diameter.
Figure 6:
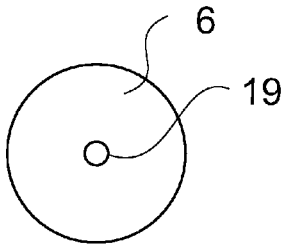
FIG. 6 is a top view of the shock absorber device with the smallest diameter.

The metallic fixation base (3), illustrated in FIG. 4, aims to provide more stability to the trucks (4) attachment to the shape (2) by providing a more rigid support to the said attachment; and provide more durability to the shape by decreasing the strain from parts of the trucks on the shape support points while the skate is being used, it also prevents material reaction, such as wood corrosion. The metallic fixation base (3) includes orifices where the fixation screws (13) and (14) that affix the said base (3) to the shape (2) pass through; weight reducing openings (15) distributed on areas susceptible to lower efforts during the use of the skate (1) aiming to reduce the weight without impairing the equipments durability. Furthermore, the metallic fixation base (3) includes two mortise apertures (16) for the bigger diameter shock absorber device (5), two apertures (17) to alleviate the torsion device deformation (8) and one mortise aperture (18) for the torsion device (8). The torsion device (8) alleviation apertures (17) allow the torsion device (8) to deform without letting the contact with the surface of the metallic fixation base (3) impair the deformation.

Between the metallic fixation base (3) and the wheels axles' fixation support (7) there are shock absorber devices (5) and (6) which provide the necessary shock absorption for maneuvering and also allow the sliding of the wheels axles' fixation support (7) relative to the metallic fixation base (3).

Said shock absorber devices (5) and (6) consist of rings of a slightly elastic material, such as polyurethane, being one with a smaller diameter (6) and the other with a bigger diameter (5). The smaller diameter shock absorber device includes one orifice (19) where the fixation screw (13) that affixes the truck (4) to the shape (2) passes through. Therefore, the smaller diameter device (6) centralizes in the fixation screw (13). The bigger diameter shock device (5) is positioned around the torsion device (8), centralized thereto. Moreover, the bigger diameter absorber device (5) includes two protrusions (20) which slot in the apertures (16) on the metallic fixation base (3), guaranteeing the alignment of the bigger diameter shock absorber device (5) with the metallic fixation base (3).

The wheels axles' fixation support (7) consists of one metal sheet folded laterally forming two side walls (21) and one central surface (22). On the wheels axles fixation support (7) side walls (21) there are weight reduction openings (23) distributed on areas susceptible to lower efforts during the use of the skate (1), being said openings (23) away from the wheels (10) and (11) axles (26) pass through apertures (24) and (25).

The axles (26) apertures (24) and (25) found on each of the said side walls (21) have different forms, the apertures of one side (24) being approximately elliptical and the apertures on the other side (25) being circular.

The wheels (10) and (11) are attached to the truck (4) by means of a simple set with few parts composed of an axle (26); two bearings (27); two spacers (28) and two screws (29).

Figure 7:
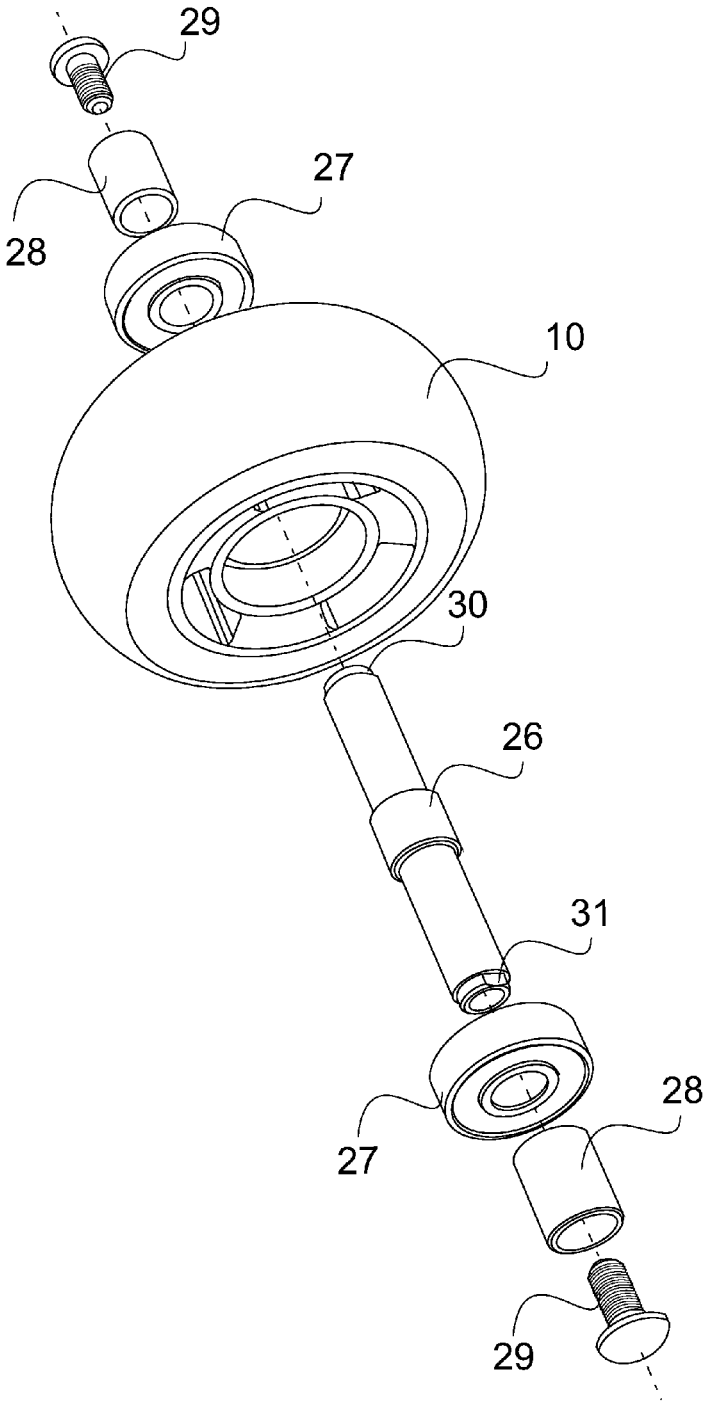
FIG. 7 is an exploded perspective view of the wheels fixation system.

The axle (26) is employed as support for the bearings (27) and is responsible for mortising the rolling system to the wheels axle's fixation support (7) side walls (21). The two bearings (27), each one being placed on each side of the wheel, enable the wheels to roll freely with little friction, which provides low wearing down due to the pressure applied for the axle fixation being put only on the bearings (27) central area, thus allowing free rotation movement. The two spacers (28), also placed one on each side of the wheel, keep the bearings (27) firm in position without restraining the rotation movement, and increase the axle mechanical resistance. Two screws (29) for the external wheels (10) are attached to the edges of each axle (26), as per illustrated in FIG. 7, being similar to the attachment of the internal wheels (11).

During mounting and dismounting of the wheels (10) and (11) to and from the axles fixation support (7), the axles (26) apertures (24), whose form is approximately elliptical, avoid the axle (26) from rotating. This way, the differentiated form of the axle (26) edges (30) and (31) facilitate screwing and unscrewing thereof. When the device is assembled, the axle (26) circular edge (30) slots in the axle (26) circular aperture (25), and the axle (26) chamfered edge (31) slots in the axle (26) elliptical aperture (24).

Figure 8:
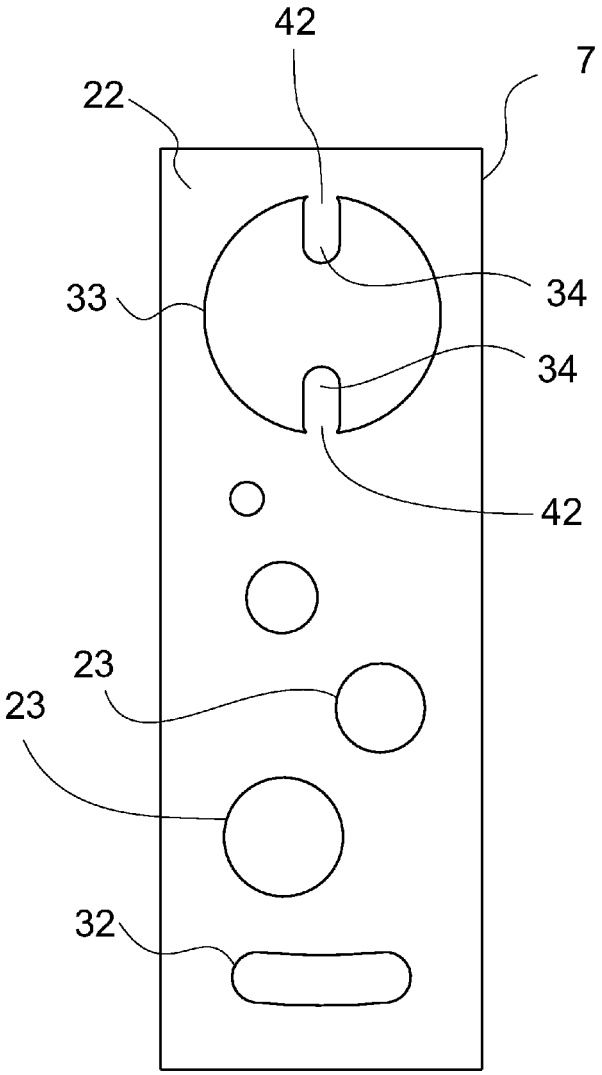
FIG. 8 is a top view of the wheels axles fixation support.
Figure 9:
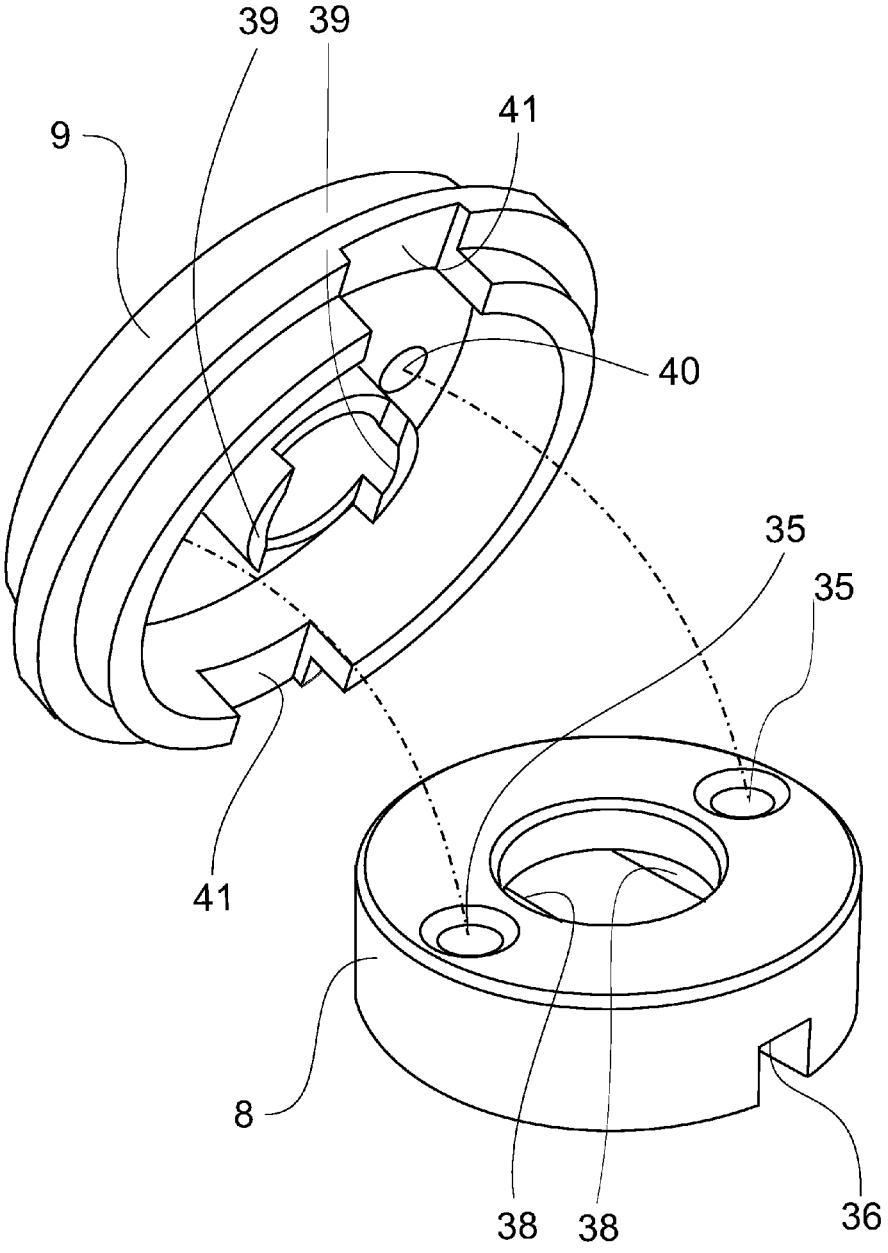
FIG. 9 is a perspective view of the fastening of the torsion device with the sleeve.

On the fixation support (7) central surface (22), shown in FIG. 8, there are weight reduction openings (23) distributed on areas susceptible to lower efforts during the use of the skate (1) so that the equipment durability is not impaired; a movement limiting aperture (32) where the fixation screw (13) slides through during the truck (4) rotation movement limiting the allowed angle for this movement; and a torsion device (8) mortise aperture (33). The said torsion device (8) mortise aperture (33) includes recesses (34) which slot in the torsion device (8).

The torsion device (8), fastened to the axles fixation support (7) central surface (22) mortise aperture (33), comprises a disc made of an elastomer material such as polyurethane; two diametrally opposed apertures (35) allowing the fixation screws to pass through (14); and two fastening apertures (36), diametrally opposed, allowing the mortise of the torsion device (8) with wheels axles fixation support (7). Moreover, the torsion device (8) includes on its upper side a central protrusion having the same format as the metallic fixation base (3) aperture (18), and on its lower side two apertures (38) where the sleeve (9) protrusions (39) slot in. The protrusion (37) slots in the metallic fixation base (3) aperture (18), guaranteeing the torsion device (8) alignment with the metallic fixation base (3).

Figure 10:
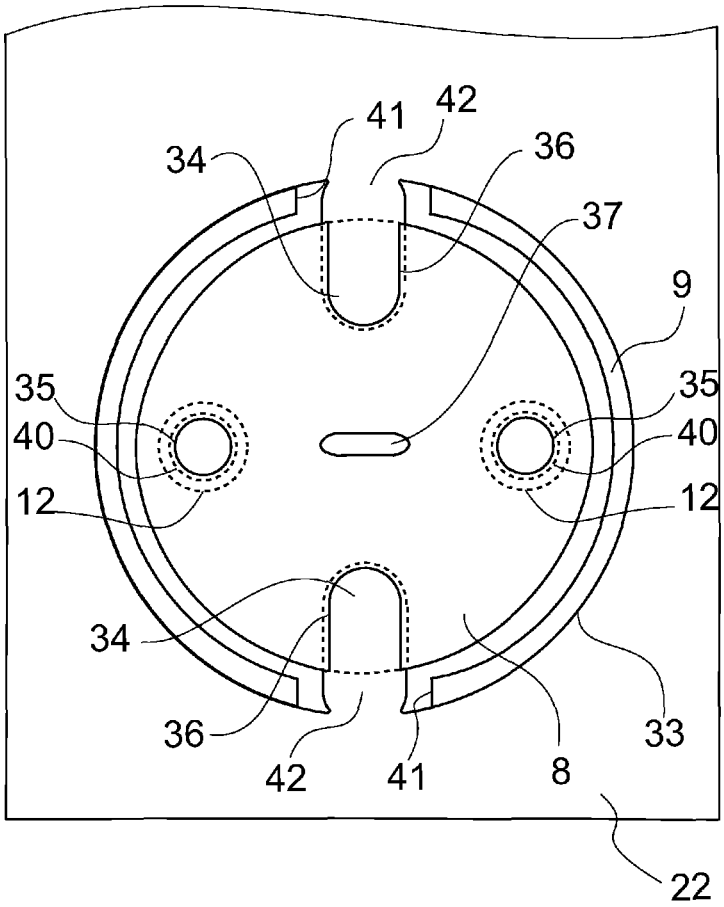
FIG. 10 is a top view of the fastening of the torsion system with the wheels axles fixation support.
Figure 1:
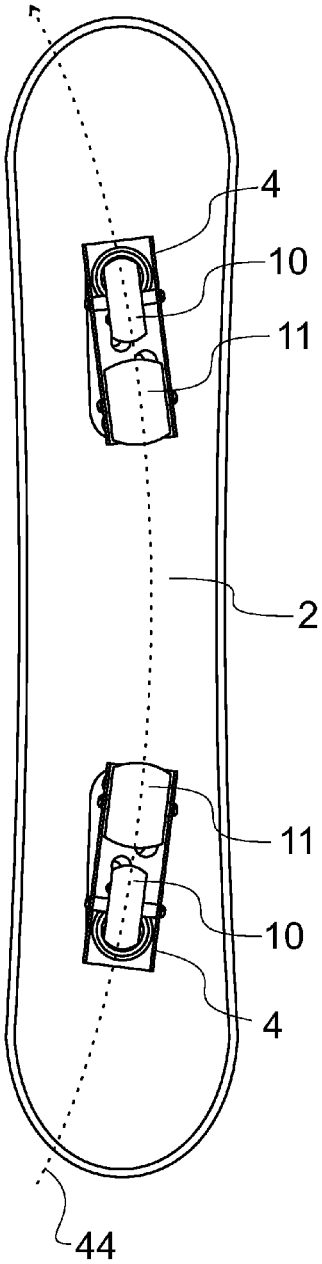

The said torsion device (8) on the wheels axles' fixation support (7) central surface (22) is illustrated in FIG. 10. The torsion device (8) is responsible for the sleeve (9) and the metallic fixation base (3) interface, which do not move in relation to the shape (2), with the wheels axles' fixation support (7). Due to the elastic characteristics employed in the torsion device (8), at the end of the turning movement, the wheels axles' fixation support (7) automatically aligns back with the other parts of the truck (4).

The sleeve (9) is a metallic device which has apertures (40) diametrally opposed whereby screws (14) are passed through; rotation movement limiting apertures (41) carved on the sleeve (9) and two protrusions (39) diametrally opposed in the same direction as the screws (14) apertures (40). The said protrusions (39) slot in the torsion device (8) apertures (38), guaranteeing the perfect alignment of the sleeve (9) with the torsion device (8).

During the trucks (4) motion due to the skates (1) maneuvers, the torsion device (8) mortise aperture (33) apertures (42) intermediary parts slide through the rotation movement limiting apertures (41) which limit the rotation angle. The said rotation movement limiting apertures (41) also provide a perfect alignment of screws apertures (12), (35) and (40) due to the mortise afforded by the format thereof, as per illustrated in FIG. 10, facilitating the truck (4) assemblage.

The trucks (4) attachment to the shape (2) is done with screws (13) and (14). The screws (14) are placed in pair to avoid the loosening thereof with the movement's vibration, which normally happens when only one central screw is used. Furthermore, due to the elastic characteristics of their materials, which provide a better fixation of the parts, the torsion device (8) and the shock absorber device (6) provide a better fixation of screws (14) and (13), respectively.

Aiming to increase the skate (1) stability, the distance between the trucks (4) is bigger than the distance between the wheels on conventional skates; therefore, the skate (1) vibration frequency is lower during maneuvering.

The trucks (4) rotation angle limit is determined according to the internal wheels (11) width. This limitation resulting from the internal wheels width (11) determine the width of the movement limitation apertures on the fixation support (7) of the axles (26) and also the width of the rotation movement limiting apertures (41) on the sleeve (9), which guarantees that the trucks (4) movement angle is limited by the internal wheels (11) width.

The trucks (4) rotation during a straight, a left turn and a right turn movements is illustrated in FIGS. 11 thru 16.

When the shape (2) tilts sideways, the rider body applies a force that makes the internal wheels (11) touch the ground. The said force starts the torsion device (8) rotation, forming a curvature radius between the trucks (4). The said radius causes the skate (1) to take on a circular movement, making turning movements possible.

During the circular movement, the maximum radius is limited by the dimensional difference between the internal wheel (11) and the external one (10), and also by movement limitation devices (41) and (32) that limit the trucks (4) rotation angle. As it returns to the initial point, the torsion device (8), due to its elastic characteristic, acts on the trucks (4) alignment causing the skate (1) to get back to a straight movement. The action of the trucks (4) torsion device (8) is only possible due to the configuration and strategic positioning of the internal wheels (11) and the external ones (10).

The internal wheel (11) is wider and has a profile composed by only one radius, whereas the external wheel (10) is narrow and has a profile defined by a concordance of the projections arches of the internal wheels (11) profile points.

Figure 12:
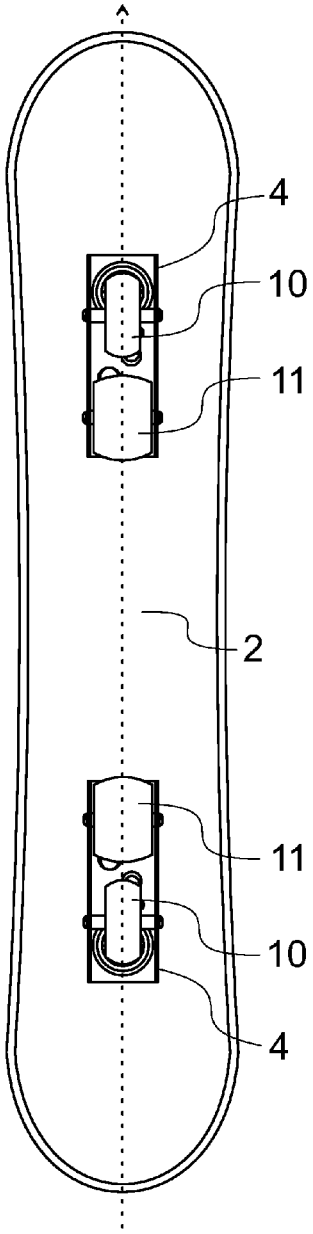
FIG. 12 is a bottom view of a skate according to the present invention in a straight forward movement.
Figure 15:
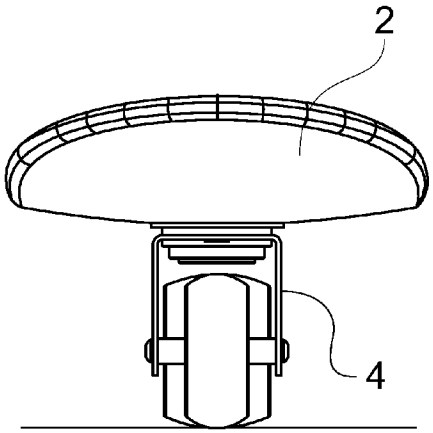
FIG. 15 is a front view of a skate according to the present invention in a straight forward movement.

According to the illustrations in FIGS. 12 and 15, the two trucks (4) four wheels (10) and (11) are perfectly aligned and in touch with the ground during the straight movement.

Figure 13:
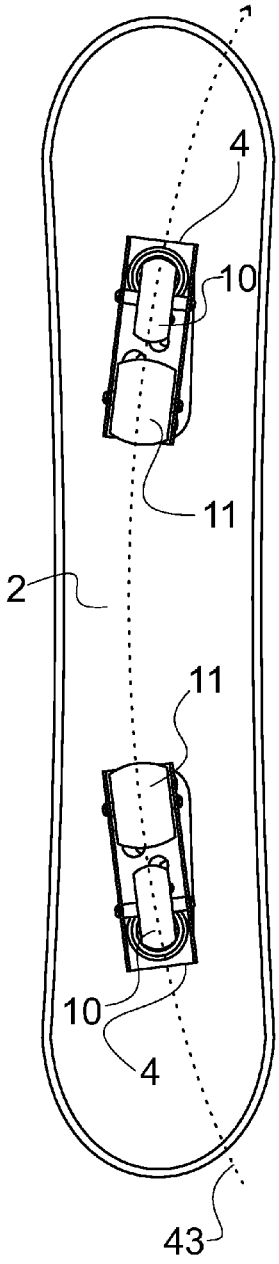
FIG. 13 is a bottom view of a skate according to the present invention in a turning movement to the left.
Figure 16:
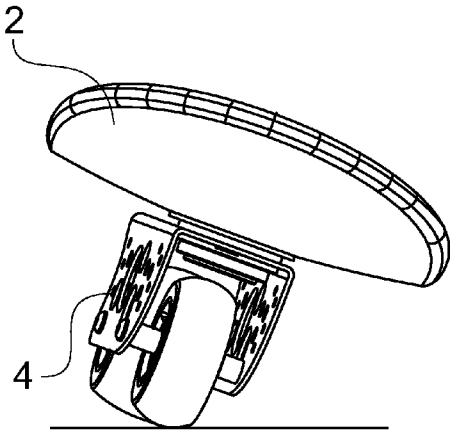
FIG. 16 is a front view of a skate according to the present invention in a turning movement to the left.

When a left turn starts, the friction between the internal wheels (11) and the ground dislocates the trucks (4) aligning them on the turning movement (43), as referred by FIG. 13. As per illustrated in FIG. 16, during this movement, the trucks (4) four wheels (10) and (11) stay in permanent contact with the ground due to their profiles curvature and width and determined distances between the axles.

Figure 14:
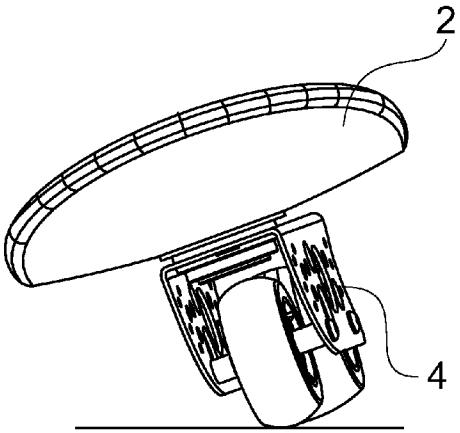
FIG. 14 is a front view of a skate according to the present invention in a turning movement to the right.

In the same way, during a right turn as per illustrated in FIGS. 11 and 14, the internal wheels (11) push the trucks (4) out to the right, aligning them with the turning movement as referred by FIG. 11. During this movement, the two trucks (4) four wheels (10) and (11) stay in permanent contact with the ground due to their profiles curvature and width and determined distances between the axles.

In order to guarantee that the two trucks (4) four wheels (10) and (11) stay in permanent contact with the ground, the external wheels (10) curvature is determined by the distance relative to the internal wheels (11) and the curvature thereof.

Firstly, the external wheels (10) width is determined by the trucks (4) rotation movement angle and by the internal wheels (11) width. The above mentioned is illustrated in FIGS. 17 and 18.

Figure 17:
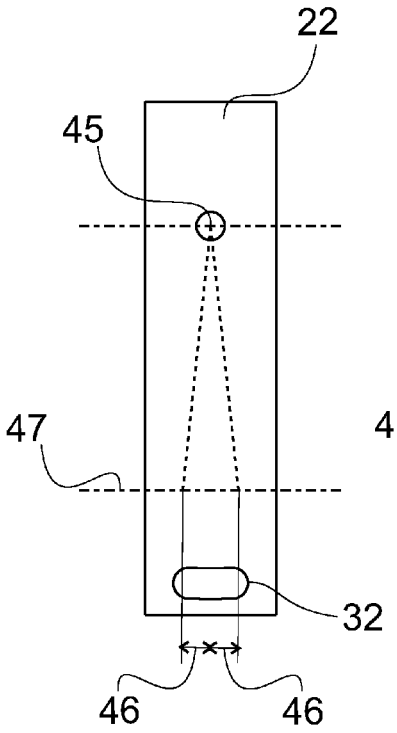
FIG. 17 is a representative view of the bottom surface of the wheels axles fixation support in order to determine the difference between the wheels widths through the movement around a point in the external wheels axles' projection.

According the FIG. 17, considering the trucks (4) rotation movement around the rotation point (45), being said rotation point (45) located on the projection of the external wheels (10) axles, an angle rotation between 3° and 9°, preferably 6° to each side, is simulated.

On this movement, the distance (46) between the movement limiting points of the auxiliary straight line segment (47) is measured, which represents the internal wheels (11) axles' projection. This measured distance (46) represents the distance between the external wheels (10) profiles lateral edge (48) and the internal wheels (11) profiles lateral edge (49) when the wheels profiles are aligned. The wheels (10) and (11) maximum radius (50) is equal.

Figure 18:
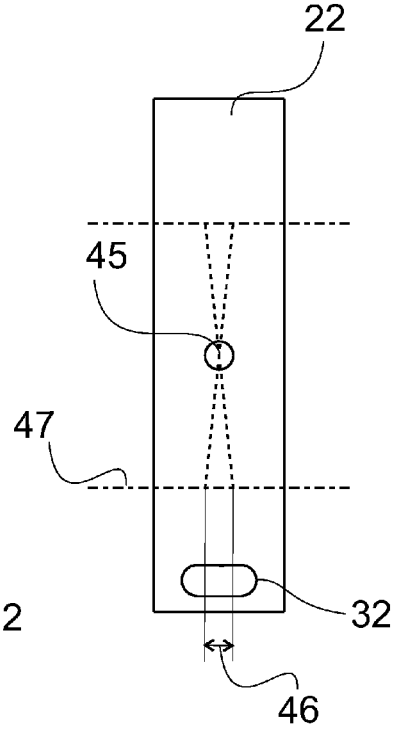
FIG. 18 is a representative view of the bottom surface of the wheels axles fixation support in order to determine the difference between the wheels widths through the movement around a point located halfway between the wheels axles.

Alternatively, a 6° rotation to each side is simulated, as illustrated in FIG. 18, where the external wheels (10) width can be determined from the trucks (4) rotation movement around the rotation point (45), being such rotation point (45) in the middle of the distance between the external wheels (10) axles projection and the internal wheels (11) projection.

During this movement, the distance (46) between the movement limiting points in the auxiliary straight line segment (47) is measured. This measured distance (46) represents the distance between the external wheels (10) profiles lateral edge (48) and the internal wheels (11) profiles lateral edge (49) when the wheels profiles are aligned.

Figure 19:
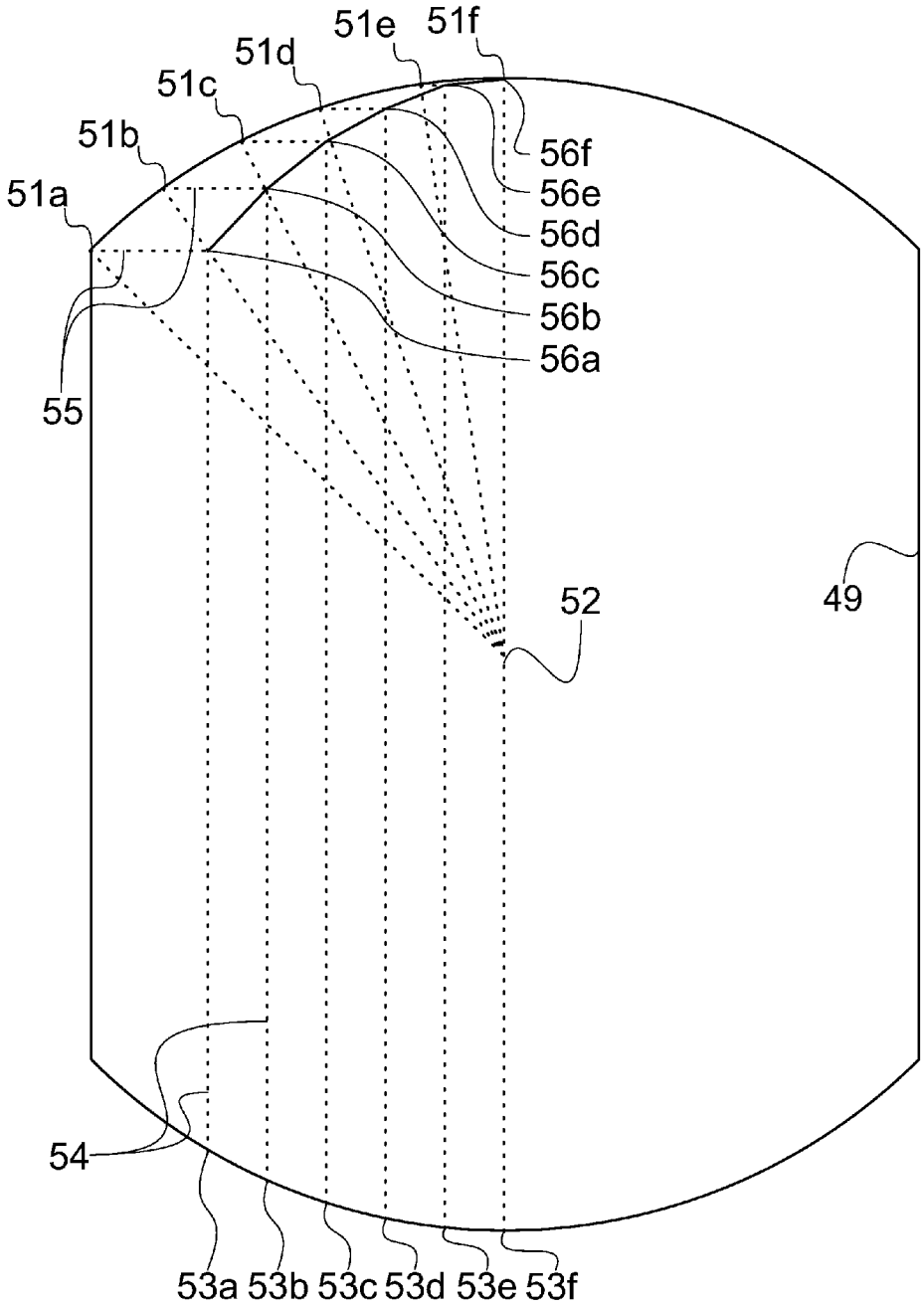
FIG. 19 is the internal wheels profile and a diagram to determine the external wheels curvature.

Secondly, the determining of the external wheels (10) curvature is made from the projections of the internal wheels (11) points, as illustrated in FIG. 19. Initially, the determined arch between the internal wheels (11) profile (49) points (51*a*) and (51*f*) is divided in five arches of the same length, determining the points (51*b*), (51*c*), (51*d*) and (51*e*). On the determined arch between points (51*a*) and (51*f*), the auxiliary straight line segments between the central point (52) and points (51*a*), (51*b*), (51*c*), (51*d*), (51*e*) and (51*f*) are drawn.

Point (53*a*) is determined according to the distance (46) that represents the difference between the widths of the internal wheels (11) and external wheels (10). Points (53*b*), (53*c*), (53*d*) and (53*e*) are determined so as the auxiliary segments (54) are distributed with equal distance. Being such auxiliary straight line segments (54) parallel to the line segment determined by points (51*f*) and (52) passing by points (53*a*), (53*b*), (53*c*), (53*d*) and (53*e*) on the determined arch between points (53*a*) and (53*f*). Following, auxiliary straight line segments (55) are drawn, being said auxiliary segments (55) perpendicular to the line segment determined by points (51*f*) and (52) passing by points (51*a*), (51*b*), (51*c*), (51*d*) and (51*e*) on the determined arch between points (51*a*) and (51*f*).

Figure 20:
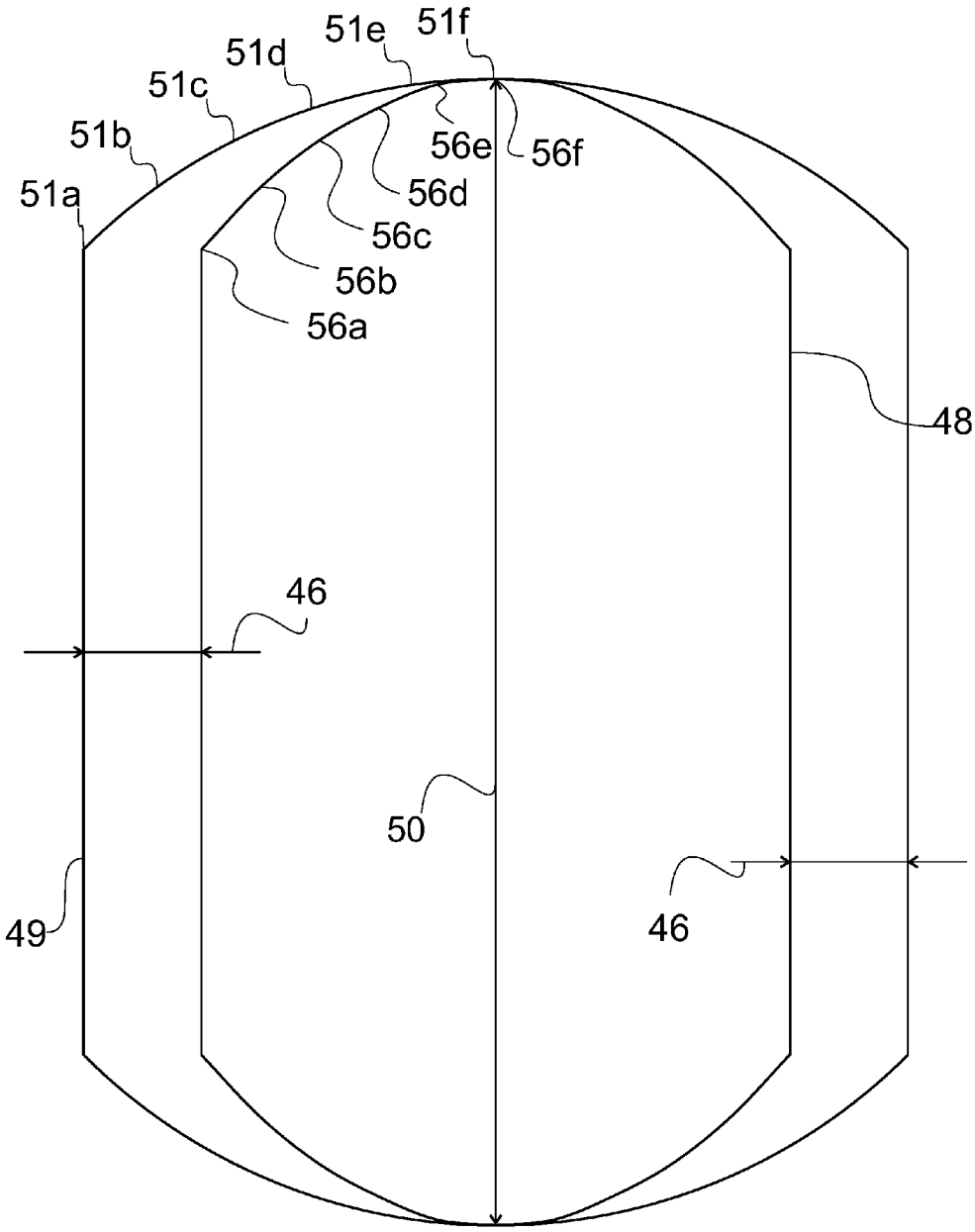
FIG. 20 is the aligned profiles of the internal and external wheels.

In the intersection between the auxiliary straight line segments (54) and the auxiliary straight line segments (55), points (56*a*), (56*b*), (56*c*), (56*d*) and (56*e*) are determined. From points (56*a*), (56*b*), (56*c*), (56*d*) and (56*e*) an arch that represents a part of the external wheels (10) curvature is drawn. By repeating the same procedure for the remaining quadrants, the external wheels (10) profile (48) is determined according to FIG. 20.

Due to the reduced number of parts and the lack of parts that require difficult assemblage, the object of the present invention has great industrial application requiring only that the factories have available resistant metallic sheets and materials such as polyurethane, besides the machinery needed for the manufacturing thereof. The device assemblage is quick and easy. The wheels set can also be marketed as a single product for posterior assembling onto the board.

The invention claimed is:

1. An inline skateboard comprising an elongated shape extending along a longitudinal axis; and a pair of trucks each rotatably attached to the shape and substantially aligned with one another along the longitudinal axis;

wherein each truck comprises:

a support;

one internal wheel rotatably supported by the support; and one external wheel rotatably supported by the support and in alignment with the internal wheel substantially along the longitudinal axis;

wherein a width of the internal wheel is greater than a width of the external wheel and a maximum radius of the internal wheel is equal to a maximum radius of the external wheel.

2. The skateboard according to claim 1, wherein the internal wheel has a profile defined by a constant radius and the external wheel has a profile defined by a radius that decreases from a center to an outer edge.

3. The skateboard according to claim 1, wherein each of the trucks is rotatable to each side of the longitudinal axis up to a predetermined angle.

4. The skateboard according to claim 3, wherein the predetermined angle is an angle between 3 degrees and 9 degrees.

5. The skateboard according to claim 1, further comprising a plurality of absorber devices disposed between each of the trucks and the shape.

6. The skateboard according to claim 1, further comprising a torsion device comprising an elastic member that is attached to the shape at least at a center thereof and that includes a fastening aperture that engages a projection on the support;

wherein each of the trucks is rotatable relative to the shape about the center of the elastic member.

7. The skateboard according to claim 6, further comprising a fixation base attaching each of the trucks to the shape.

8. The skateboard according to claim 7, wherein the fixation base further comprises:

a plurality of torsion deformation apertures to alleviate deformation of the torsion device.

9. The skateboard according to claim 6, further comprising a sleeve disposed over the torsion device and including a pair of apertures diametrically opposed to one another whereby screws are passed through; rotation movement limiting apertures, and two protrusions diametrically opposed and in the same direction as the screws apertures.

10. The skateboard according to claim 9, further comprising a fastener that extends through the torsion device and the sleeve, and attaches each of the trucks to the shape.

11. The skateboard according to claim 1, further comprising an axle supporting each of the wheels on the respective support, wherein:

the support of each of the trucks comprises a metal sheet that includes two side walls and one central surface extending between the two side walls; and each of the side walls including a plurality of axle pass-through apertures.

12. The skateboard of claim 11, wherein the metal sheet includes weight reduction openings distributed on areas susceptible to lower forces during the use of the skate and positioned at a distance away from the axle pass through apertures.

13. The skateboard of claim 11, wherein the axle pass-through apertures on one of the side walls of each truck are approximately elliptical, and the axle pass-through apertures on the other of the side walls are circular.

14. The skateboard according to claim 11, wherein one end of each of the axles has a circular edge and the other end of each of the axles has a chamfered edge.

15. The skateboard according to claim 1, further comprising:

an axle supporting each of the wheels on the respective support; and a pair of bearings attaching each of the wheels to the respective axle.

16. The skateboard according to claim 1, further comprising a movement limiting aperture that limits the angle of rotation of each of the trucks.

17. The skateboard according to claim 16, wherein the angle of rotation of each of the trucks is limited by the width of the internal wheels and a length of the support movement limiting aperture.

18. The skateboard according to claim 1, wherein a difference between the width of the internal wheels and the width of the external wheels is equal to a distance that the internal wheels are movable in a direction perpendicular to the longitudinal axis when the truck rotates.

* * * * *